US005422211A

United States Patent [19]

Law et al.

[11] Patent Number: 5,422,211

[45] Date of Patent: * Jun. 6, 1995

[54] IMAGING MEMBERS WITH TRISAZO PHOTOGENERATING MATERIALS

[75] Inventors: Kock-Yee Law, Penfield; Ihor W. Tarnawskyi, Webster, both of N.Y.

[73] Assignee: Xerox Corporation, Stamford, Conn.

[ * ] Notice: The portion of the term of this patent subsequent to Sep. 14, 2010 has been disclaimed.

[21] Appl. No.: 54,626

[22] Filed: Apr. 30, 1993

[51] Int. Cl.[6] ..... G03G 5/047; G03G 5/06

[52] U.S. Cl. ..... 430/59; 430/58; 430/79

[58] Field of Search ..... 430/59, 58, 79

[56] References Cited

U.S. PATENT DOCUMENTS

| | | | |
|---|---|---|---|
| 4,175,258 | 11/1979 | Borkowski et al. | 331/78 |
| 4,299,896 | 11/1981 | Hashimoto et al. | 430/58 |
| 4,390,611 | 6/1983 | Ishikawa et al. | 430/59 |
| 4,507,471 | 3/1985 | Ohta | 534/755 |
| 4,551,404 | 11/1985 | Hiro et al. | 430/59 |
| 4,618,672 | 10/1986 | Hashimoto | 534/658 |
| 4,713,307 | 12/1987 | Law et al. | 430/57 |
| 4,797,337 | 1/1989 | Law et al. | 430/58 |
| 4,916,039 | 4/1990 | Hashimoto et al. | 430/57 |
| 5,244,761 | 9/1993 | Law et al. | 430/59 |

*Primary Examiner*—Mark A. Chapman
*Attorney, Agent, or Firm*—E. O. Palazzo

[57] ABSTRACT

An imaging member comprised of supporting substrate, a photogenerator layer comprised of trisazo pigments as essentially represented by the formula (I),

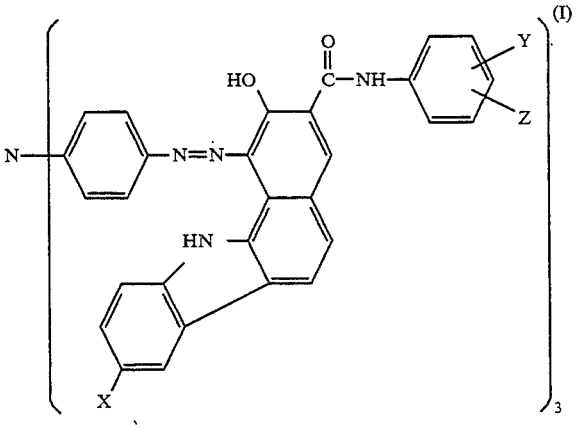

wherein X and Y are halogen, and Z is alkyl; and a charge transport layer.

19 Claims, No Drawings

IMAGING MEMBERS WITH TRISAZO PHOTOGENERATING MATERIALS

BACKGROUND OF THE INVENTION

The present invention is directed generally to photoresponsive imaging members, and more specifically to photoconductive imaging members comprised of certain trisazo photogenerating pigments. In embodiment, the trisazo photogenerating pigments are obtained from anilides, especially certain alkyl chloroanilides. One embodiment of the present invention is directed to an imaging member comprised of a supporting substrate, a photogenerating layer comprised of a certain trisazo photogenerating pigment in contact therewith, and a charge, especially hole, transport layer. Imaging members with the trisazo photogenerating pigments of the present invention are sensitive to wavelengths of from about 400, especially 450 to about 800 nanometers, that is from the visible region to the near infrared wavelength region of the light spectrum, and these imaging members in many instances possess excellent electrials, and outstanding time zero electricals, such as a dark decay of −30 volts/second, and $E_{\frac{1}{2}}$ of about 1.5 ergs/cm$^2$ at 790 nanometers, thus enabling use thereof in imaging systems with high speeds, for example exceeding 70 CPM, and have excellent cycling characteristics. In embodiments thereof, the imaging members of the present invention generally possess lower dark decay characteristics as illustrated herein.

Photoresponsive imaging members are known, such as those comprised of a homogeneous layer of a single material such as vitreous selenium, or composite layered devices containing a dispersion of a photoconductive composition. An example of a composite xerographic photoconductive member is described in U.S. Pat. No. 3,121,006, which discloses finely divided particles of a photoconductive inorganic compound dispersed in an electrically insulating organic resin binder. Imaging members prepared according to the teachings of this patent contain a binder layer with particles of zinc oxide uniformly dispersed therein coated on a paper backing. The binders disclosed in this patent include materials such as polycarbonate resins, polyester resins, polyamide resins, and the like, which are incapable of transporting injected charge carriers generated by the photoconductive particles for any significant distance.

Photoreceptor materials comprising inorganic or organic materials wherein the charge generating and charge transport functions are performed by discrete contiguous layers are also known. Additionally, layered photoreceptor members are disclosed in the prior art, including photoreceptors having an overcoat layer of an electrically insulating polymeric material. Other layered,photoresponsive devices have been disclosed, including those comprising separate photogenerating layers and charge transport layers as described in U.S. Pat. No. 4,265,990, the disclosure of which is totally incorporated herein by reference. Photoresponsive materials containing a hole injecting layer overcoated with a hole transport layer, followed by an overcoating of a photogenerating layer, and a top coating of an insulating organic resin are disclosed in U.S. Pat. No. 4,251,61.2, the disclosure of which is totally incorporated herein by reference. Examples of photogenerating layers disclosed in these patents include trigonal selenium and phthalocyanines, while examples of transport layers include certain aryl diamines as illustrated therein.

U.S. Pat. No. 3,574,181 discloses disazo compounds useful as coloring agents. Composite electrophotographic photosensitive materials containing various azo compounds are disclosed in U.S. Pat. No. 4,618,672, wherein bisazo compounds particularly suitable for use in the charge generating layer of a layered electrophotographic photoconductor are illustrated. Similarly, an article by M. Hashimoto entitled "Electrophotographic Sensitivity of Fluorenone Bisazo Pigments", *Electrophotography*, Vol. 25, No. 3 (1986), discloses disazo compounds as charge generating materials in electrophotographic layered photoreceptors. Further, Japanese Pat. No. Kokai No. 54-20736 discloses disazo pigments as constituents in electrophotographic processes. Japanese Pat. No. 58-177955 also discloses many disazo compounds suitable for use in the photosensitive layer of an electrophotographic device.

U.S. Pat. No. 4,713,307, the disclosure of which is hereby totally incorporated by reference, also discloses photoconductive imaging members containing a supporting substrate, certain azo pigments as photogenerating materials, and a hole transport layer that preferably contains an aryl diamine compound dispersed in an inactive resinous binder.

U.S. Pat. No. 4,797,337, the disclosure of which is totally incorporated herein by reference, discloses a photoconductive imaging member comprising a supporting substrate, a hole transport layer, and a photogenerating layer comprising specific disazo compounds.

Documents illustrating layered organic electrophotographic photoconductor elements with azo, bisazo, and related compounds include U.S. Pat. No. 4,390,611, U.S. Pat. No. 4,551,404, U.S. Pat. No. 4,596,754, Japanese Pat. No. 60-64354, U.S. Pat. No. 4,400,455, U.S. Pat. No. 4,390,608, U.S. Pat. No. 4,327,168, U.S. Pat. No. 4,299,896, U.S. Pat. No. 4,314,015, U.S. Pat. No. 4,486,522, U.S. Pat. No. 4,486,519, U.S. Pat. No. 4,555,667, U.S. Pat. No. 4,440,845, U.S. Pat. No. 4,486,800, U.S. Pat. No. 4,309,611, U.S. Pat. No. 4,418,133, U.S. Pat. No. 4,293,628, U.S. Pat. No. 4,427,753, U.S. Pat. No. 4,495,264, U.S. Pat. No. 4,359,513, U.S. Pat. No. 3,898,084, U.S. Pat. Nos. 4,830,944, and 4,820,602; *Electrophotography*, K. Ota, 25, (30, 303, (1986), Japanese 62-139308 (1987), and Japanese Patent Publication 60-111247. With the invention of the present application, there are selected for the imaging members certain trisazo photogenerating pigments, which pigments are sensitive to wavelengths of light of from about 400 to about 800 nanometers, thereby permitting the photoconductive imaging members with these pigments to be selected for infrared printers, LED printers, and electrophotographic imaging processes, and the like.

U.S. Pat. No. 4,424,266 discloses an electrophotographic photosensitive element having a conductive support and a photosensitive layer comprising a carrier generating phase layer containing a carrier generating material selected from the group consisting of perylene dyes, polycyclic quinones and azo dyes, and a carrier transporting phase layer containing a hydrazone carrier transporting material. The carrier generator materials can be used either singly or in combination.

Japanese Patent Publication J01-198-763 discloses an electrophotographic photoreceptor containing a bisazo series compound in a photosensitive layer formed on a conductive support. A charge transport material is used with the bisazo pigment as a charge generation material, such as 2,4,7-trinitrofluorenone, tetracyanoquinodimethane, carbazole, triarylalkane derivatives, phenylenediamine derivatives, hydrazone compounds, or stilbene derivatives.

The following United States patents may also be of interest: U.S. Pat. No. 4,507,471 which discloses certain trisazo compounds, see column 2 for example, which compounds can be used for developing charge carrier generating compounds which are highly sensitive and have a uniform sensitivity throughout the visible region; and U.S. Pat. Nos. 4,916,039, and 4,925,758 which disclose a photoconductive layer comprising the azo pigments as illustrated, for example, in column 3; also disclosed as a starting material for preparing the azo pigments is a 2-hydroxy-3-carbamoylbenzo(a)carbazole derivative.

There is illustrated in U.S. Pat. No. 5,175,258 (D/90393) a process for the preparation of bisazo photogenerating pigments which comprises the reaction of diaminofluorenone with sodium nitrite, hydrochloric acid, and fluoboric acid; thereafter reacting the resulting product with an anilide coupler; and subsequently annealing the product obtained; U.S. Pat. No. 5,139,910 illustrates bisazo compounds essentially as represented by the formula of FIG. 9 wherein Cp is an azoic coupler such as 2-hydroxy-3-naphtho-o-methoxyanilide; 2-hydroxy-3-naphtho-p-methoxyanilide; 2-hydroxy-3-naphtho-p-trifluoromethylanilide; 2-hydroxy-3-naphtho-o-methylanilide; 2-hydroxy-3-naphtho-p-chloroanilide; 2-hydroxy-3-naphtho-p-methylanilide; 2-hydroxy-3naphtho-p-fluoroanilide; 2-hydroxy-3-naphtho-o-chloroanilide; 2-hydroxy-3-naphtho-m-trifluoromethylanilide; 2-hydroxy-3-naphtho-p-nitroanilide; 2-hydroxy-3-naphtho-o-ethylanilide; 2-hydroxy-3-naphtho-o-fluoroanilide; 2-hydroxy-3-naphtho-p-bromoanilide; and the like, and photoconductive imaging members thereof; and U.S. Pat. No. 5,130,443.

Illustrated in U.S. Pat. No. 5,244,761 (D/91106) are layered imaging members with certain fluorinated trisazo photogenerating pigments of the formulas as shown in the Figures for example. One of the design considerations for low D.D. and high sensitivity trisazo pigments is to have an ortho substituent for low D.D. and have halo groups in the carbazole ring and the anilide ring for improving the sensitivity. In U.S. Pat. No. 5,244,761, halogens are situated at both ortho and para position of the anilide ring and in the carbazole ring.

The disclosures of each of the aforementioned patent applications and patent are totally incorporated herein by reference.

Although known imaging members are suitable for their intended purposes, a need remains for imaging members containing certain trisazo materials. In addition, a need exists for imaging members containing photoconductive materials with improved photoconductivity. There is also a need for imaging members with photoconductive materials comprised of certain trisazo photogenerating pigments, wherein the material has enhanced dispersability in polymers and solvents. Further, there is a need for photoconductive materials with enhanced dispersability in polymers and solvents that enable low cost coating processes in the manufacture of photoconductive imaging members. Additionally, there is a need for photoconductive materials that enable imaging members with enhanced photosensitivity in the red and infrared wavelength regions of the light spectrum, enabling the resulting imaging members thereof to be selected for LED xerographic imaging processes and printers, and diode laser printer and imaging apparatuses. There remains a need for trisazo compounds for improved xerographic performance. Also, a need exists for the direct preparation of certain trisazo photogenerating pigments from halo o-alkylanilines.

SUMMARY OF THE INVENTION

It is an object of the present invention to provide imaging members with many of the advantages illustrated herein.

It is another object of the present invention to provide imaging members with photoconductive materials with improved photoconductivity.

It is another object of the present invention to provide photoconductive imaging members with certain trisazo photogenerating pigments that enable imaging members with enhanced photosensitivity from the visible to the infrared wavelength regions of the light spectrum, such as from about 400 to about 800 nanometers.

In one embodiment of the present invention there are provided layered imaging members with certain trisazo photogenerating pigments.

Another object of the present invention relates to the preparation of certain trisazo photogenerating pigments from 2-ethyl-4halo, especially chloro, anilines.

One embodiment of the present invention is directed to layered imaging members comprised of supporting substrate, a photogenerating layer comprised of photogenerating pigments comprised of the trisazo compounds represented, or essentially represented by the formulas provided herein.

In embodiments, the imaging members of the present invention are comprised of, in the order indicated, a conductive substrate, a photogenerating layer comprising trisazo-4, or tris-5 photogenerating pigments, optionally dispersed in a resinous binder composition, and a charge transport layer, which comprises charge transporting molecules dispersed in an inactive resinous binder composition.

In another embodiment, the photoconductive imaging member comprises a conductive substrate, a hole transport layer comprising a hole transport composition, such as an aryl amine, dispersed in an inactive resinous binder composition, and as a top layer a photogenerating layer comprising the trisazo photogenerating pigments optionally dispersed in a resinous binder composition; or a conductive substrate, a hole blocking metal oxide layer, an optional adhesive layer, a photogenerating layer comprised of a trisazo photogenerating pigment of the present invention or mixtures thereof, optionally dispersed in a resinous binder composition, and an aryl amine hole transport layer comprising aryl amine hole transport molecules optionally dispersed in a resinous binder.

The substrate can be formulated entirely of an electrically conductive material, or it can be an insulating material having an electrically conductive surface. The substrate is of an effective thickness, generally up to about 100 mils, and preferably from about 1 to about 50 mils, although the thickness can be outside of this range. The thickness of the substrate layer depends on many factors, including economic and mechanical considerations. Thus, this layer may be of substantial thickness, for example over 100 mils, or of minimal thickness provided that there are no adverse effects on the system. In a particularly preferred embodiment, the thickness of this layer is from about 3 mils to about 10 mils. The substrate can be opaque or substantially transparent and can comprise numerous suitable materials having the desired mechanical properties. The entire substrate can comprise the same material as that in the electrically conductive surface, or the electrically conductive surface can merely be a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, titanium, silver, gold, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like. The substrate layer can vary in thickness over substantially wide ranges depending on the desired use of the electrophotoconductive member. Generally, the conductive layer ranges in thickness of from about 50 Angstroms to many centimeters, although the thickness can be outside of this range. When a flexible electrophotographic imaging member is desired, the thickness typically is from about 100 Angstroms to about 750 Angstroms. The substrate can be of any other conventional material, including organic and inorganic materials. Typical substrate materials include insulating nonconducting materials such as various resins known for this purpose including polycarbonates, polyamides, polyurethanes, paper, glass, plastic, polyesters such as MYLAR® (available from DuPont) or MELINEX 447® (available from ICI Americas, Inc.), and the like. If desired, a conductive substrate can be coated onto an insulating material. In addition, the substrate can comprise a metallized plastic, such as titanized or aluminized MYLAR®, wherein the metallized surface is in contact with the photogenerating layer or any other layer situated between the substrate and the photogenerating layer. The coated or uncoated substrate can be flexible or rigid, and can have any number of configurations, such as a plate, a cylindrical drum, a scroll, an endless flexible belt, or the like. The outer surface of the substrate preferably comprises a metal oxide such as aluminum oxide, nickel oxide, titanium oxide, and the like.

In embodiments, intermediate adhesive layers between the substrate and subsequently applied layers may be desirable to improve adhesion. If such adhesive layers are utilized, they preferably have a dry thickness of from about 0.1 micron to about 5 microns, although the thickness can be outside of this range. Typical adhesive layers include film-forming polymers such as polyester, polyvinylbutyral, polyvinylpyrolidone, polycarbonate, polyurethane, polymethylmethacrylate, and the like as well as mixtures thereof. Since the surface of the substrate can be a metal oxide layer or an adhesive layer, the expression "substrate" as employed herein is intended to include a metal oxide layer with or without an adhesive layer on a metal oxide layer.

The trisazo photogenerating pigments of the present invention are represented by the formula

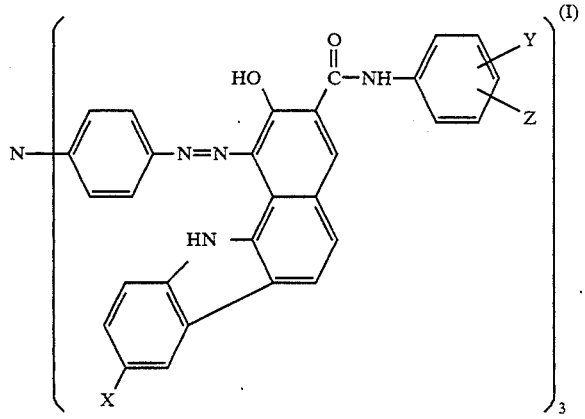

wherein X and Y are halogen, and Z is alkyl; and a charge transport layer, wherein alkyl contains 1 to about 25 carbon atoms, such as methyl, ethyl, and the like; and halogen is preferably chloro or fluoro.

The photogenerating layer is of an effective thickness, for example, of from about 0.05 micron to about 10 microns or more, and in embodiments has a thickness of from about 0.1 micron to about 3 microns. The thickness of this layer, however, is dependent primarily upon the concentration of photogenerating material in the layer, which may generally vary from about 5 to 100 percent. When the photogenerating material is present in a binder material, the binder preferably contains from about 30 to about 95 percent by weight of the photogenerating material, and preferably contains about 80 percent by weight of the photogenerating material. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, such as the specific photogenerating compound selected, the thicknesses of the other layers, and whether a flexible photoconductive imaging member is desired.

Charge transport layers are well known in the art. Typical transport layers are described, for example, in U.S. Pat. Nos., 4,265,990; 4,609,605; 4,297,424 and 4,921,773, the disclosures of each of these patents being totally incorporated herein by reference. Organic charge transport materials can also be employed. Typical charge, especially hole, transporting materials include the following.

Hole transport molecules of the type described in U.S. Pat. Nos. 4,306,008; 4,304,829; 4,233,384; 4,115,116; 4,299,897; 4,081,274, and 5,139,910, the disclosures of each of which are totally incorporated herein by reference, can be selected for the imaging members of the present invention. Typical diamine hole transport molecules include N,N'-diphenyl-N,N'-bis(3-methylphenyl)-(1,1'-biphenyl)4,4'-diamine, N,N'-diphenyl-N,N'-bis(4-methylphenyl)-(1,1'-biphenyl)-4,4'-diamine, N,N'-diphenyl-N,N'-bis(2-methylphenyl)-(1,1'-biphenyl)4,4'-diamine, N,N'-diphenyl-N,N'-bis(3-ethylphenyl)-(1,1'-biphenyl)4,4'-diamine, N,N'-diphenyl-N,N'-bis(4-ethylphenyl)-(1,1'-biphenyl)4,4'-diamine, N,N'-diphenyl-N,N'-bis(4-n-butylphenyl)-(1,1'-biphenyl)4,4'-diamine, N,N'-diphenyl-N,N'-bis(3-chlorophenyl)-(1,1'-biphenyl)4,4'-diamine, N,N'-diphenyl-N,N'-bis(4-chlorophenyl)-(1,1'-biphenyl)4,4'-diamine, N,N'-diphenyl-N,N'-bis(phenylmethyl)-(1,1'-biphenyl)4,4'-diamine, N,N,N',N'-tetraphenyl-[2,2'-dimethyl-1,1'-biphenyl]4,4'-diamine, N,N,N',N'-tetra-(4-methylphenyl)-[2,2'-dimethyl-1,1'-biphenyl]4,4'-diamine, N,N'-diphenyl-N,N'-bis(4-methylphenyl)-[2,2'-dimethyl-1,1 '-biphenyl]4,4'-diamine, N,N'-diphenyl-N,N'-bis(2-methylphenyl)-[2,2'-dimethyl-1,1 '-biphenyl]4,4'-diamine, N,N'-diphenyl-N,N'-bis(3-methylphenyl)-[2,2'-dimethyl-1,1 '-biphenyl]4,4'-diamine, N,N'-diphenyl-N,N'-bis(3-methylphenyl)-pyrenyl-1,6-diamine, and the like.

Pyrazoline transport molecules as disclosed in U.S. Pat. Nos. 4,315,982; 4,278,746 and 3,837,851, the disclosures of each of which are totally incorporated herein by reference, can also be selected. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like.

Substituted fluorene charge transport molecules as described in U.S. Pat. No. 4,245,021, the disclosure of which is totally incorporated herein by reference, can also be selected. Typical fluorene charge transport molecules include 9-(4'-dimethylaminobenzylidene)fluorene, 9-(4'-methoxybenzylidene)fluorene, 9-(2', 4'-dimethoxybenzylidene)fluorene, 2-nitro-9-benzylidene-fluorene, 2-nitro-9-(4'-diethylaminobenzylidene)fluorene, and the like.

Oxadiazole transport molecules such as 2,5-bis(4-diethylaminophenyl)-1,3,4-oxadiazole, pyrazoline, imidazole, triazole, and the like. Other typical oxadiazole transport molecules are described, for example, in German Pat. Nos. 1,058,836; 1,060,260 and 1,120,875, the disclosures of each of which are totally incorporated herein by reference can also be selected.

In embodiments of the present invention a preferred hole transport layer is comprised of components as represented, or essentially represented, by the following general formula

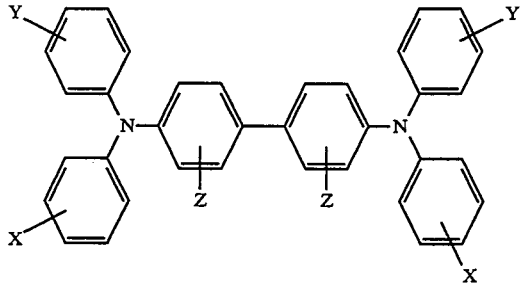

wherein X, Y and Z are selected from the group consisting of hydrogen, an alkyl group with, for example, from 1 to about 25 carbon atoms and a halogen, preferably chlorine, and at least one of X, Y and Z is independently an alkyl group or chlorine. When Y and Z are hydrogen, the compound may be named N,N'-diphenyl-N,N'-bis(alkylphenyl)-(1,1'-biphenyl)4,4'-diamine wherein the alkyl is, for example, methyl, ethyl, propyl, n-butyl, or the like, or the compound may be N,N'-diphenyl-N,N'-bis(chlorophenyl)-(1,1'-biphenyl)4,4'-diamine.

The charge transport material is present in the charge transport layer in an effective amount, generally from about 5 to about 90 percent by weight, preferably from about 20 to about 75 percent by weight, and more preferably from about 30 to about 60 percent by weight, although the amount can be outside of this range.

Examples of the highly insulating and transparent resinous components or inactive binder resinous material for the transport layer include materials such as those described in U.S. Pat. No. 3,121,006, the disclosure of which is totally incorporated herein by reference. Specific examples of suitable organic resinous materials include polycarbonates, arcylate polymers, vinyl polymers, cellulose polymers, polyesters, polysiloxanes, polyamides, polyurethanes, polystyrenes, and epoxies as well as block, random or alternating copolymers thereof. Preferred electrically inactive binder materials are polycarbonate resins having a molecular weight of from about 20,000 to about 100,000 with a molecular weight in the range of from about 50,000 to about 100,000 being particularly preferred. Generally, the resinous binder contains from about 5 to about 90 percent by weight of the active material corresponding to the foregoing formula, and preferably from about 20 percent to about 75 percent of this material.

Similar binder materials may be selected for the photogenerating layer, including polyesters, polyvinyl butyrals, polyvinylcarbazole, polycarbonates, polyvinyl formals, poly(vinylacetals) and those illustrated in U.S. Pat. No. 3,121,006, the disclosure of which is totally incorporated herein by reference.

The photoconductive imaging member may optionally contain a charge blocking layer situated between the conductive substrate and the photogenerating layer. This layer may comprise metal oxides, such as aluminum oxide and the like, or materials such as silanes and nylons. Additional examples of suitable materials include polyisobutyl methacrylate, copolymers of styrene and acrylates such as styrene/n-butyl methacrylate, copolymers of styrene and vinyl toluene, polycarbonates, alkyl substituted polystyrenes, styrene-olefin copolymers, polyesters, polyurethanes, polyterpenes, silicone elastomers, mixtures thereof, copolymers thereof, and the like. The primary purpose of this layer is to prevent charge injection from the substrate during and after charging. This layer is of a thickness of less than 50 Angstroms to about 10 microns, preferably being no more than about 2 microns.

In addition, the photoconductive imaging member may also optionally contain an adhesive interface layer situated between the hole blocking layer and the photogenerating layer. This layer may comprise a polymeric material such as polyester, polyvinyl butyral, polyvinyl pyrrolidone and the like. Typically, this layer is of a thickness of less than about 0.6 micron.

The reaction of an alkylamine, such as o-ethylaniline, with an acetic acid anhydride to form an acetanilide, such as 2'-ethylacetanilide. The resulting acetanilide can then be reacted with a hydrogen halide, such as hydrogen chloride, in the presence of hydrogen peroxide to form a halogenated product in the para position of the acetyl group, such as 2'-ethyl-4'-chloroacetanilide. The halogenated acetanilide can be hydrolyzed in an aqueous alcoholic solution of hydrochloric acid to form a halogenated o-ethylaniline, such as 2-ethyl-4-chloroaniline. This halogenated o-ethylaniline is then reaction with a phenyl 2-hydroxy-11H-benzo(a)carbazole-3-carboxylate derivatives, such as phenyl 2-hydroxy-8-fluoro-11H-benzo(a)carbazole-3-carboxylate, phenyl 2-hydroxy-8-chloro-11H-benzo(a)carbazole-3-carboxylate, or phenyl 2-hydroxy-11H-benzo(a)carbazole-3-carboxylate to form the corresponding carbazole anilide coupler such as 2-hydroxy-8-fluoro-11H-benzo(a)-carbazole- 3-carbox-2'-ethyl-4'-chloroanilide, 2-hydroxy-8-chloro-11H-benzo(a)carbazole-3-carbox-2'-ethyl-4'-chloroanilide, 2-hydroxy-11H-benzo(a)carbazole-3-carbox-2'-ethyl-4'-chloroanilide, etc. These new carbazole anilide couplers can then be used to synthesize the trisazo pigments of the present invention.

Initially azotizing tris(p-aminophenyl)amine with an excess amount, for example, of from about 2 to about 10, and preferably from about 2 to about 5 equivalents of a metallic nitrite, such as sodium nitrite, at a temperature of from about −10° to about 30° C. in an acid aqueous solution, such as a solution of hydrochloric acid. The resulting hexazonium or tris(diazo) salts formed can be isolated as the tetrafluoroborate, or hexafluorophosphate salts by, for example, adding from about 2 to about 50, and preferably from about 10 equivalents of $HBF_4$, or $HPF_6$ to the salt solution. Thereafter the salt can be dissolved in a solvent, such as dimethylformamide, at a temperature of from about −10° to about 30° C., and the mixture resulting is allowed to react with about 3 equivalents or more of an azoic coupler, such as 2-hydroxy-8-chloro-11H-benzo(a)carbazole-3-carbox-2'-ethyl-4'-chloroanilide, and 2-hydroxy-8-fluoro-11H-benzo(a)carbazole-3-carbox-2'-ethyl-4'-chloroanilide at a temperature of from about −10° to about 30° C. Subsequently, the desired trisazo products are precipitated out of solution by the addition of about 10 equivalents of a base, such as sodium acetate. Thereafter, the trisazo can be isolated by known means, such as filtration, and purified by solvent washings if desired. Washing can be accomplished with water for the primary purpose of removing inorganic impurities and followed by washing with dimethylformamide for the purpose of removing any organic impurities. The resulting trisazo product can be identified by melting point data, elemental analysis, infrared spectroscopy.

The photogenerating compounds of the present invention in embodiments thereof enable enhanced photosensitivity in the infrared wavelength range. In particular, imaging members with photosensitivity at wavelengths of up to about 800 (nm) nanometers, are provided in embodiments of the present invention, which renders them particularly useful for imaging and printing applications such as LED and diode laser printing processes, which typically require sensitivity of about 600 to about 800 nanometers.

The present invention also encompasses a method of generating images with the photoconductive imaging members disclosed herein. The method comprises the steps of generating an electrostatic latent image on a photoconductive imaging member of the present invention, developing the latent image, and transferring the developed electrostatic image to a substrate. Optionally, the transferred image can be permanently affixed to the substrate. Development of the image may be achieved by a number of methods, such as cascade, touchdown, powder cloud, magnetic brush, and the like. Transfer of the developed image to a substrate may be by any method, including those making use of a corotron or a biased roll. The fixing step may be performed by means of any suitable method, such as flash fusing, heat fusing, pressure fusing, vapor fusing, and the like. Any material used in xerographic copiers and printers may be used as a substrate, such as paper, transparency material, or the like.

Specific embodiments of the invention will now be described in detail. These Examples are intended to be illustrative, and the invention is not limited to the materials, conditions, or process parameters set forth in these embodiments. All parts and percentages are by weight unless otherwise indicated.

EXAMPLE I

Synthesis of 2-Ethyl-4-chloroaniline:

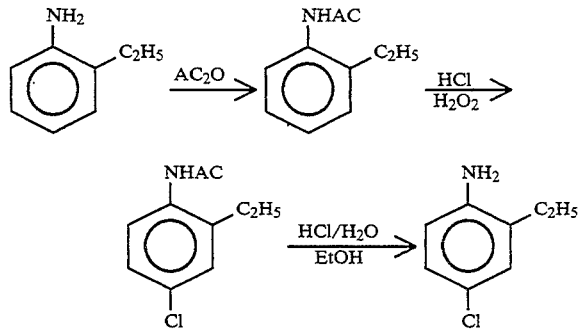

o-Ethylaniline (40 grams, 0.33 moles), acetic acid anhydride (40 grams) and a small amount of zinc dust (about 50 milligrams) were mixed with about 30 milliliters of acetic acid inside a 250 milliliter round bottom flask at room temperature. An exotherm was observed during the mixing process. After the exothermic reaction was subsided, the mixture was brought to reflux for about 1 hour. It was then cooled and allowed to stir at room temperature overnight resulting in a solid mass. The solid product was transferred to a beaker with 200 milliliters of water. White precipitated product was obtained and was stirred in an ice water bath for about 1.5 hours. The product was then collected by filtration and was washed with water. After vacuum drying (room temperature), 44.6 grams (83 percent) of a white solid product, identified as 2'-ethylacetanilide, was obtained.

m.p.: 110.5° to 111.5° C. IR(KBr): 3,272 (N—H) and 1,655 $cm^{-1}$ (C═O) $^{13}C$ NMR (DMSO-$d_6$): δ14.2, 23.2, 23.9, 125.5, 125.9, 126.2, 128.5, 136.0, 138.0 and 168.7 ppm 2'-Ethylacetanilide was dissolved in 400 milliliters of ethanol (200 proof) inside a 3-neck 2 liter flask. Subsequently, 400 milliliters of concentrated HI was introduced and the mixture was cooled to about 0° C. by a salt ice bath. About 100 milliliters of $H_2O_2$ (30 percent by weight) was added slowly through a dropping funnel in about 45 minutes. After stirring the resulting mixture for 1.5 hours at 0° C., it was warmed up to about 20° C. and was maintained at about 20° C. for another hour. About 1 liter of ice water was added and the mixture was chilled to 0° C. by an ice water bath. The precipitated product formed was collected by filtration. It was then transferred to a 1 liter beaker and was stirred with 500 milliliters of water for about 10 minutes. After collecting the purified product by filtration, it was rinsed with water and vacuum dried (80° C. at 2 millimeters Hg for 4 to 6 hours), yielding 31 grams (55 percent)of 2'-ethyl-4'-chloroacetanilide.

m.p.: 117° to 122° C. IR(KBr): 3,258 (N—H) and about 1,660 $cm^{-1}$ (C=O) $^{13}C$ NMR (DMSO-$d_6$): δ13.8, 23.2, 23.7, 125.7, 127.4, 128.1, 129.5, 134.8, 139.9 and 168.7 ppm 2'-Ethyl-4'-chloroacetanilide (31 grams) was heated to reflux in a mixture containing 80 milliliters of ethanol and 55 milliliters of concentrated HCL for about 2.5 hours. After cooling to room temperature, the mixture was basified to a pH of about 8 by an aqueous NaOH solution (20 percent). An oily aniline layer was observed. The mixture was transferred to a separatory funnel and was extracted with ether (3 times 75 milliliters). The ethereal extracts were combined and dried over $MgSO_4$. After filtration, ether was removed under reduced pressure. 2-Ethyl-4-chloroaniline was purified and isolated by a reduced pressure distillation, yield 14.2 grams (58 percent).

b.p.: 119° to 121° C. at 7 millimeters Hg IR(neat): 3,466, 3,385 and 3,225 (N—H), 3,028 (aromatic C—H), 2,970, 2,938 and 2,889 (aliphatic C—H), and 1,624 $cm^{-1}$ (aromatic C—C) $^{13}C$ NMR (DMSO-$d_6$): δ12.8, 23.4, 115.8, 119.8, 126.3, 128.0, 128.9 and 144.8 ppm Calculated for $C_8H_{10}NCl$: C61.72, H6.47, N9.04 Found: C62.15, H6.61, N8.97

EXAMPLE II

Synthesis of 2-Hydroxy-8-fluoro-11H-benzo(a)carbazole-3-carbox-2'-ethyl-4'-chloroanilide:

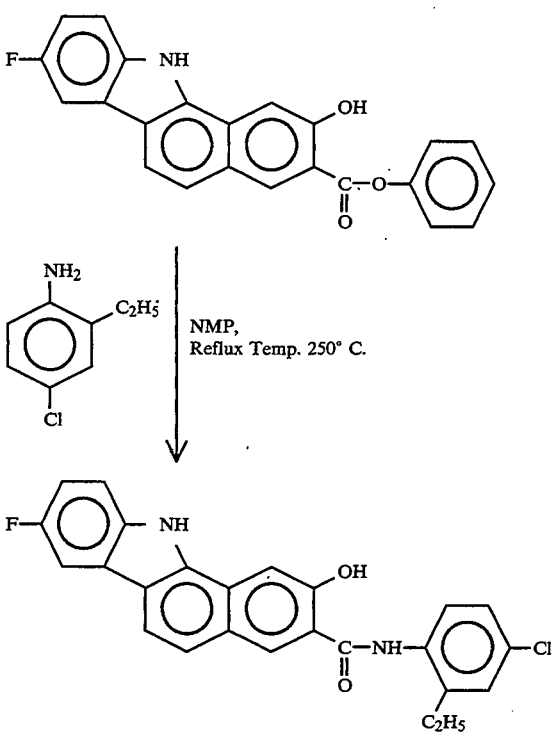

Phenyl 2-hydroxy-8-fluoro-11H-benzo(a)carbazole-3-carboxylate (6 grams, 0.0162 moles), 2-ethyl-4-chloroaniline (12.61 grams, 0.081 mole) and 5 milliliters of N-methyl pyrrolidinone were charged into a 100 milliliter 3-necked flask, which was equipped with a magnetic stirrer and a nitrogen inlet. The mixture was stirred and heated to reflux at a bath temperature of about 250° C. under a $N_2$ atmosphere. After 6 hours, TLC analysis revealed that all the starting phenyl ester was consumed. The mixture was cooled to room temperature and 100 milliliters of ethanol were introduced. The yellow precipitate obtained was isolated by filtration. After washing with methanol and vacuum drying, 6.4 grams of crude product were obtained. It was then recrystallized from a mixture of DMF and MeOH (30 milliliters/50 milliliters) yielding a purified product which was identified as 2-hydroxy- 8- fluoro-11H-benzo(a)carbazole-3-carbox-2'-ethyl-4'-chloroanilide, 5.4 grams (77 percent).

m.p. >310° C. IR(KBr): 3,450, 3,365 (N—H) and 1,655 $cm^{-1}$ (amide C=O) Calculated for $C_{25}H_{18}N_2O_2FCl$: C69.37, H4.19, N6.47 Found: C68.97, H4.22, N6.52

EXAMPLE III

Synthesis of 2-Hydroxy-8-chloro-11H-benzo(a)carbazole-3-carbox-2'-ethyl-4'-chloroanilide:

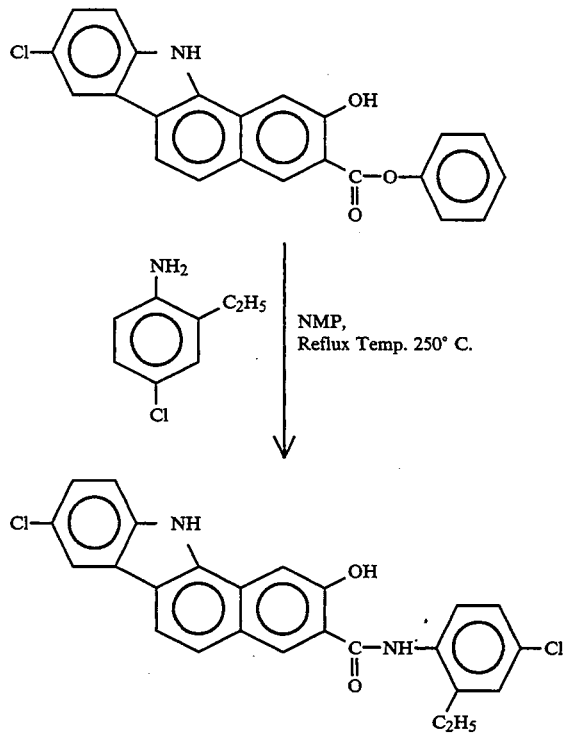

The procedure of Example II was repeated with the exception that phenyl 2-hydroxy-8-chloro-11H-benzo(a)carbazole-3-carboxylate was used in place of phenyl-2-hydroxy-8-fluoro-11H-benzo(a)carbazole-3-carboxylate, affording pure 2-hydroxy-8-chloro-11H-benzo(a)carbazole-3-carbox-2'-ethyl-4'-chloroanilide, a yellow solid, in 66 percent yield.

m.p.: >310° C. IR(KBr): 3,440, 3,363 (N—H) and 1,652 $cm^{-1}$ (amide C=O) Calculated for $C_{25}H_{18}N_2O_2Cl_2$: C66.82, H4.04, N6.23

Found: C66.61, H4.21, N6.12

EXAMPLE IV

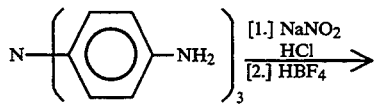

-continued

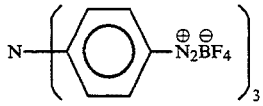

[1.]

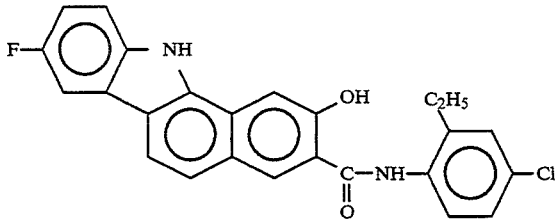

[2. ] NaOAC

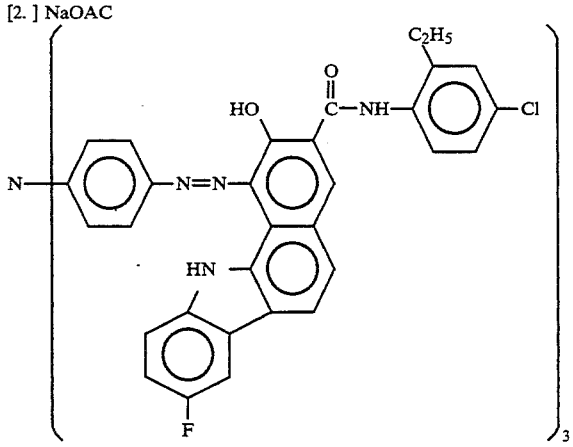

Tris(4-aminophenyl) amine (0.58 gram, 2 millimoles) was stirred in an aqueous solution containing 14 milliliters of 18 percent hydrochloric acid at about 60° C. for 1 hour and then 16 hours at room temperature. The dispersion obtained was then cooled to 0 to 5° C. by an ice water bath. A cold aqueous solution of sodium nitrite (0.6 gram in 1.5 milliliters) was added dropwise. After the addition, the resulting mixture was stirred in an ice bath for another 30 minutes. A clear brown solution resulted. The dark brown solution was filtered (by a medium sintered glass funnel) into a 250 milliliter precooled filtration flask. Fluoboric acid (5 milliliters) was added to the cold filtrate and a yellow precipitate was formed. This mixture was stirred at ice cold temperature for another 30 minutes. The yellow precipitate was collected by filtration. After washing with cold water, cold methanol and ether, about 1.25 gram of a tris(diazonium) salt was obtained after drying, IR(KBr): 3,118 (C—H) and 2,300 $cm^{-1}$ (—N≡N).

The tris(diazonium) salt was dissolved in about 30 milliliters of cold DMF in a 1 liter 3-neck flask, which was surrounded by an ice water bath. A cold DMF solution containing 2.87 grams (6.6 millimoles) 2-hydroxy-8-fluoro-11H-benzo(a)carbazole-3-carbox-2'-ethyl-4'-chloroanilide in about 120 milliliters of DMF was added into the salt solution. A cold aqueous solution of 3 grams of NaOAc in 45 milliliters of water was added in 30 minutes. The temperature of the DMF solution was kept below 7° C. during the addition. After the addition was completed, the ice bath was removed and the product was stirred at room temperature overnight. Crude pigment was isolated by filtration (fine sintered glass funnel). The crude product was then purified by washing with warm water (2 times 250 milliliters at 80° C.), warm DMF (3 times 250 milliliters at 80° C.), acetone and ether, yielding a dark blue pigment, which was identified as tris[4-(1'-azo-2'-hydroxy-8'-fluoro-11'H-benzo(a)carbazole-3'-carbox-2''-ethyl-4''-chloroanilide)phenyl]amine, yield 2.36 grams (73 percent).

m.p. >310° C. IR(KBr): 3,440 (N—H) and 1,675 $cm^{-1}$ (amide C=O) Calculated for $C_{93}H_{63}N_{13}O_6F_3Cl_3$: C68.87, H3.92, N11.23 Found: C68.72, H4.15, N11.16

EXAMPLE V

Trisazo pigment, tris[4-(1'-azo-2'-hydroxy-8'-chloro-11'H-benzo(a)carbazole-3'-carbox-2''-ethyl-4''-chloroanilide)phenyl]amine (tris-5), was synthesized using the procedures of Example IV with the exception that 2-hydroxy-8-chloro-11H-benzo(a)carbazole-3-carbox-2'-ethyl-4'-chloroanilide was used as a coupler (in place of 2-hydroxy-8-fluoro-11H-benzo(a)carbazole-3-carbox-2'-ethyl-4'-chloroanilide), yield 2.31 grams (69percent).

m.p.: >310° C. IR(KBr): 3,438 (N—H) and 1,676 $cm^{-1}$ (amide C=O) Calculated for $C_{93}H_{63}N_{13}O_6F_3Cl_3$: C66.83, H3.80, N10.89 Found: C66.24, H3.92, N10.72

EXAMPLE VI

There was prepared a layered photoconductive imaging member containing the trisazo pigment of Example IV, tris[4-(1'-azo-2'-hydroxy-8'-fluoro-11'H-benzo(a)-carbazole-3'-carbox-2''-ethyl-4''-chloroanilide)phenyl-]amine.

The photogenerating pigment dispersion was prepared by first dissolving in a 1 ounce brown bottle 52.8 milligrams of polyvinyl formal (obtained from Scientific Polymer Products, Inc., formal content 82 percent, acetate content 12 percent, hydroxy content 6 percent) and 10 milliliters of tetrahydrofuran. To the bottle was then added 211.2 milligrams of the above trisazo pigment, tris[4-(1'-azo-2'-hydroxy-8'-fluoro-11'H-benzo(a)-carbazole-3'-carbox-2''-ethyl-4''-chloroanilide)phenyl-]amine and about 90 grams of steel shot (⅛ inch diameter, number 302 stainless steel shot). The bottle was then placed on a Red Devil Paint Conditioner (Model 5100X) and shaken for about 30 minutes. The resulting dispersion was coated onto a 7.5 inch by 10 inch brush-grained aluminum substrate obtained from Ron Ink Company using a Gardner Mechanical Drive with a 6 inch wide Bird Film Applicator (0.5 mil wet gap) inside a humidity controlled glove box. The relative humidity of the glove box was controlled by dry air to about 25 percent, or less. The resulting photogenerator layer was air dried for about 30 minutes and then vacuum dried for about 1 hour at 100° C. before further coating. The thickness of the charge generator layer was about 0.4 micron as estimated from TEM micrographs.

The above charge generator layer was overcoated with a hole transport layer comprised of 60 weight percent of the polycarbonate MAKROLON® obtained from Larkensabricken Bayer AG, and 40 percent of aryl diamine hole transport molecules prepared as follows. A solution containing 4.2 grams of MAKROLON®, a polycarbonate resin obtained from Larkensabricken Bayer A.G., 2.8 grams of N,N'-bis(3''-methylphenyl)-1,1'-biphenyl-4,4'-diamine prepared as disclosed in U.S. Pat. No. 4,265,990, the disclosure of which is totally incorporated herein by reference, was prepared by dissolving the above materials in 31 milliliters of methylene chloride inside a 2 ounce amber bottle. The transport layer was obtained by coating the solution onto the charge generator layer using a 3.5 inch wide, 5 mil wet gap Bird Film Applicator, resulting in a transport layer about 27 microns thick. The resulting photoconductive device was air dried for about 1 hour and vacuum dried at 100° C. for about 16 hours before evaluation on a flat plate imaging test fixture.

More specifically, the imaging member thus prepared was evaluated as follows. Xerographic measurements were made on a flat plate scanner using 2 inch by 2.5 inch samples of the imaging member prepared as described herein. The surface potential of the device was monitored with a capacitively coupled ring probe connected to a Keithley electrometer (Model 610C) in the Coulomb mode. The output of the electrometer was displayed on a strip-chart recorder (HP Model 740A) which was calibrated by applying known voltage on an uncoated aluminum substrate. The exposure wavelength and the intensity were selected and adjusted using interference and neutral density filters, respectively. With the shutter closed, the dark decay was measured. With the shutter open, the photosensitivity at a known light exposure was recorded. The imaging member was charged to about −1,000 volts at the peak voltage and was allowed to discharge in the dark for 2 to 3 seconds to determine the dark decay. Subsequently, the imaging member was exposed to an erase lamp to photodischarge the surface charge and to determine its residual voltage ($V_R$). Thereafter, the imaging member was charged in a similar manner and exposed to monochromatic radiation at the dark development potential ($V_{ddp}$), and the sensitivity of the member was determined in terms of $E_{\frac{1}{2}}$, which represents the energy required to discharge half of the dark development potential. The imaging member exhibited a dark development potential ($V_{ddp}$) of −900 volts, a dark decay of −37 volts per second, an $E_{\frac{1}{2}ddp}$, the energy to discharge half the potential at 600 nanometers (erg/cm$^2$), of 2.6 and $E_{\frac{1}{2}ddp}$, the energy to discharge half the potential at 790 nanometers (erg/cm$^2$), of 1.7.

EXAMPLE VII

There was prepared a photoconductive imaging member containing the trisazo pigment prepared in Example IV using the fabrication procedures described in Example VI with the exception that a titanized MYLAR® substrate was used in place of the aluminum substrate. The imaging member exhibited a dark development potential ($V_{ddp}$) of −940 volts, a dark decay of −30 volts per second, an $E_{\frac{1}{2}ddp}$, the energy to discharge half the potential at 600 nanometers (erg/cm$^2$), of 2.6 and $E_{\frac{1}{2}ddp}$, the energy to discharge half the potential at 790 nanometers (erg/cm$^2$), of 1.5.

EXAMPLE VIII

There was prepared a photoconductive imaging member containing the trisazo pigment prepared in Example V, tris[4-(1'-azo-2'-hydroxy-8'-chloro-11'H-benzo(a)carbazole-3'-carbox-2''-ethyl-4''-chloroanilide)phenyl]amine using the fabrication procedures described in Example VI.

The imaging member exhibited a dark development potential ($V_{ddp}$) of −860 volts, a dark decay of −56 volts per second, an $E_{\frac{1}{2}ddp}$, the energy to discharge half the potential at 600 nanometers (erg/cm$^2$), of 2.5 and $E_{\frac{1}{2}ddp}$, the energy to discharge half the potential at 790 nanometers (erg/cm$^2$), of 1.5.

Comparative Example

There was prepared comparative trisazo pigment, tris[4-(1'-azo-2'-hydroxy-11'H-benzo(a)carbazole-3'-carbox-2''-ethylanilide)phenyl]amine, using the procedures of Example IV with the exception that the coupler chosen was 2-hydroxy-11H-benzo(a)carbazole-3-carbox-2'-ethylanilide. The yield of the above trisazo pigment was 72 percent.

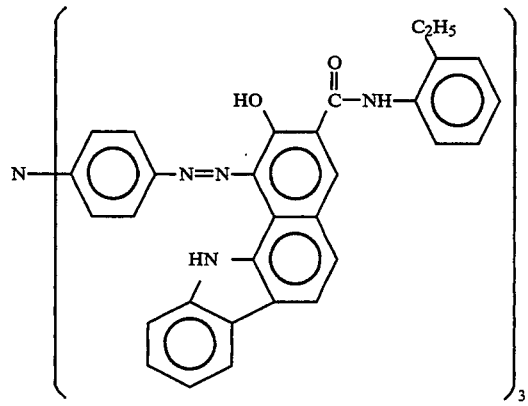

A photoconductive imaging member was prepared using the above trisazo pigment and the procedure of Example VI. The imaging member exhibited a dark development potential ($V_{ddp}$) of −950 volts, a dark decay of −32 volts per second, an $E_{\frac{1}{2}}$ value of 4.0 ergs/cm$^2$ at 600 nanometers and an $E_{\frac{1}{2}}$ value of 3.6 ergs/cm$^2$ at 790 nanometers.

Other embodiments and modifications of the present invention may occur to those skilled in the art subsequent to a review of the information presented herein; these embodiments and modifications, as well as equivalents thereof, are also included within the scope of this invention.

What is claimed is:

1. An imaging member comprised of supporting substrate, a photogenerator layer comprised of trisazo pigments as essentially represented by the formula (I),

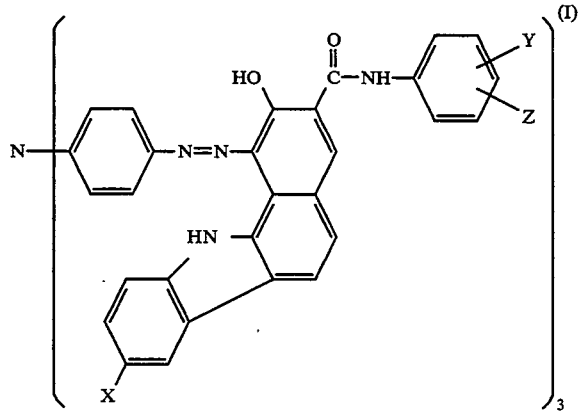

wherein X and Y are halogen of fluorine or chlorine, and Z is orthoethyl; and a charge transport layer.

2. An imaging member according to claim 1 wherein the photogenerator layer is situated between the substrate and the charge transport layer.

3. An imaging member according to claim 1 wherein the charge transport layer is situated between the substrate and the photogenerator layer.

4. An imaging member according to claim 1 wherein the supporting substrate is comprised of a conductive substrate comprised of a metal.

5. An imaging member according to claim 4 wherein the conductive substrate is aluminum, aluminized MYLAR ®, or titanized MYLAR ®.

6. An imaging member according to claim 1 wherein the photogenerator layer has a thickness of from about 0.05 to about 10 microns.

7. An imaging member according to claim 1 wherein the photogenerator layer has a thickness of from about 0.05 to about 10 microns.

8. An imaging member according to claim 1 wherein the photogenerating compound is dispersed in a resinous binder in an amount of from about 5 percent by weight to about 95 percent by weight.

9. An imaging member according to claim 8 wherein the resinous binder is selected from the group consisting of polyesters, polyvinyl butyrals, polycarbonates, and polyvinyl formals.

10. An imaging member according to claim 1 wherein the charge transport layer comprises an aryl amine molecules.

11. An imaging member according to claim 10 wherein the aryl amine is of the formula

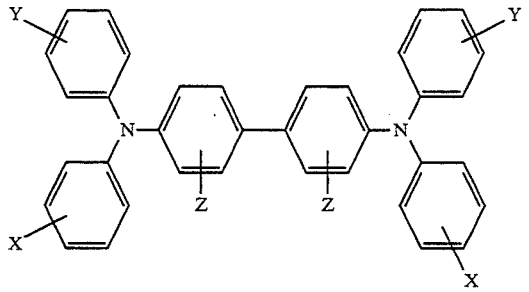

wherein X is selected from the group consisting of alkyl and halogen, and wherein the aryl amine is dispersed in a highly insulating and transparent organic resinous binder.

12. An imaging member according to claim 11 wherein the resinous binder is selected from the group consisting of polycarbonates and polystyrenes.

13. A method of imaging which comprises generating an electrostatic latent image on an imaging member of claim 1, developing the latent image, and transferring the developed electrostatic image to a suitable substrate.

14. A method of imaging which comprises generating an electrostatic latent image on an imaging member of claim 1, developing the latent image, and transferring the developed electrostatic image to a suitable substrate.

15. An imaging member in accordance with claim 1 wherein the trisazo is tris[4-(1'-azo-2'-hydroxy-8'-fluoro-11'H-benzo(a)carbazole-3'-carbox-2''-ethyl-4''-chloroanilide)phenyl]amine, or tris[4-(1'-azo-2'-hydroxy-8'-chloro-11'H-benzo(a)carbazole-3'-carbox-2''-ethyl-4''-chloroanilide)phenyl]amine.

16. An imaging member consisting essentially of a supporting substrate, a photogenerating layer containing a photogenerating pigment of tris[4-(1'-azo-2'-hydroxy-8'-fluoro-11'H-benzo(a)carbazole-3'-carbox-2''-ethyl-4''-chloroanilide)phenyl]amine, and a charge transport layer.

17. An imaging member in accordance with claim 16 wherein the dark decay thereof is −30 volts/per second, and which imaging member has an $E_{\frac{1}{2}}$ of about 1.5 ergs/cm$^2$ at 790 nanometers.

18. An imaging member in accordance with claim 16 wherein the dark development potential is −900 volts/per second, the dark decay is −37 volts per second, and the $E_{\frac{1}{2}}$ is about 2.6 ergs/cm$^2$ at 600 nanometers.

19. An imaging member comprised of a supporting substrate, a photogenerating layer containing trisazo pigments and a charge transport layer in contact therewith, the improvement residing in selecting as the photogenerating pigment the trisazo pigment tris[4-(1'-azo-2'-hydroxy-8'-chloro-11'H-benzo(a)carbazole-3'-carbox-2''-ethyl-4''-chloroanilide)phenyl]amine.

* * * * *